US010526867B2

(12) United States Patent
Witt et al.

(10) Patent No.: US 10,526,867 B2
(45) Date of Patent: Jan. 7, 2020

(54) METHODS OF SEALING A HYDROCARBON WELL

(71) Applicants: Joseph W. Witt, The Woodlands, TX (US); Brandon Max Baumert, Aberdeen (GB)

(72) Inventors: Joseph W. Witt, The Woodlands, TX (US); Brandon Max Baumert, Aberdeen (GB)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 15/939,979

(22) Filed: Mar. 29, 2018

(65) Prior Publication Data

US 2019/0003280 A1 Jan. 3, 2019

Related U.S. Application Data

(60) Provisional application No. 62/526,820, filed on Jun. 29, 2017.

(51) Int. Cl.

| | |
|---|---|
| ***E21B 33/13*** | (2006.01) |
| ***E21B 43/11*** | (2006.01) |
| ***E21B 43/117*** | (2006.01) |
| ***E21B 33/12*** | (2006.01) |
| ***E21B 34/06*** | (2006.01) |
| *E21B 34/00* | (2006.01) |

(52) U.S. Cl.

CPC ..... *E21B 33/13* (2013.01); *E21B 33/12* (2013.01); *E21B 34/063* (2013.01); *E21B 43/117* (2013.01); *E21B 2034/007* (2013.01)

(58) Field of Classification Search

None

See application file for complete search history.

(56) References Cited

U.S. PATENT DOCUMENTS

| | | | |
|---|---|---|---|
| 2,684,030 | A | 7/1954 | Muskat et al. |
| 3,057,295 | A | 10/1962 | Christopher |
| 4,676,309 | A | 6/1987 | Gonzalez |
| 6,016,753 | A | 1/2000 | Glenn et al. |
| 6,298,913 | B1 | 10/2001 | Box |
| 6,505,559 | B1 | 1/2003 | Joslin et al. |
| 6,792,866 | B2 | 9/2004 | Grattan |

(Continued)

*Primary Examiner* — Anuradha Ahuja

(74) *Attorney, Agent, or Firm* — ExxonMobil Upstream Research Company—Law Department

(57) ABSTRACT

Methods of sealing a hydrocarbon well containing a control line. The hydrocarbon well includes a casing string extending within a wellbore and defining a casing conduit, production tubing extending within the casing conduit and defining a tubing conduit, and at least one control line extending within an annular space. The methods include fluidly isolating a downhole region of the tubing conduit from an uphole region of the tubing conduit and actuating a shape charge device. The actuating includes forming a plurality of openings within the production tubing and severing the at least one control line. The methods also include positioning a diversion structure within the uphole region of the tubing conduit, pumping a sealing material into the annular space at the sealing material injection region, and curing the sealing material to form a fluid seal that extends within the annular space and the uphole region of the tubing conduit.

20 Claims, 8 Drawing Sheets

(56) References Cited

U.S. PATENT DOCUMENTS

| | | | | |
|---|---|---|---|---|
| 7,073,448 | B2 | 7/2006 | Bell | |
| 7,661,367 | B2 | 2/2010 | Yang et al. | |
| 8,561,683 | B2 | 10/2013 | Wood et al. | |
| 2005/0199401 | A1* | 9/2005 | Patel | E21B 33/1208 166/387 |
| 2011/0203795 | A1* | 8/2011 | Murphy | C09K 8/42 166/292 |
| 2013/0269948 | A1* | 10/2013 | Hoffman | E21B 33/035 166/351 |
| 2014/0083702 | A1* | 3/2014 | Godfrey | C09K 8/422 166/295 |
| 2015/0361759 | A1* | 12/2015 | Kjorholt | E21B 33/13 166/286 |
| 2017/0030157 | A1* | 2/2017 | Hansen | E21B 49/081 |

* cited by examiner

METHODS OF SEALING A HYDROCARBON WELL

CROSS REFERENCE TO RELATED APPLICATION

This application claims the priority of U.S. Provisional Application Ser. No. 62/526,820 filed Jun. 29, 2017, the disclosure of which is incorporated herein by reference in its entirety.

FIELD OF THE DISCLOSURE

The present disclosure relates to methods of sealing a hydrocarbon well.

BACKGROUND OF THE DISCLOSURE

Hydrocarbon wells that extend within a subterranean formation periodically must be plugged, abandoned, and/or sealed, such as to restrict fluid flow therein. As an example, and subsequent to production of an economically viable fraction of hydrocarbons from a given subterranean formation, one or more hydrocarbon wells may be plugged and abandoned. The plugging and abandonment process generally includes formation of one or more fluid seals within wellbores of the hydrocarbon wells, and these fluid seals may be configured to resist fluid flow therepast.

Several conventional processes for plugging and abandonment of hydrocarbon wells exist. These conventional processes for plugging and abandonment may be effective in situations in which no control lines extend within wellbores of the hydrocarbon wells. For example, control lines often extend within a wellbore and exterior to a well's production tubing. When control lines are present, they represent a potential leak path through the fluid seals, and it may be undesirable to permit this potential leak path to remain after the wellbore is plugged and abandoned.

Thus, more involved plugging and abandonment procedures have been developed for hydrocarbon wells that include control lines. These more involved procedures generally include operations to remove both tubing and control lines, which extend within the wellbore, prior to forming the fluid seal within the wellbore. Additionally or alternatively, coiled tubing may be utilized to position the fluid seal within the wellbore. Both of these operations are time-consuming and costly. Thus, there exists a need for improved methods for sealing a hydrocarbon well.

SUMMARY OF THE DISCLOSURE

Methods of sealing a hydrocarbon well containing at least one control line. The hydrocarbon well includes a wellbore extending within a subterranean formation, a casing string extending within the wellbore and defining a casing conduit, production tubing extending within the casing conduit and defining a tubing conduit, and at least one control line extending within an annular space defined between the casing string and the production tubing.

The methods include fluidly isolating a downhole region of the tubing conduit from an uphole region of the tubing conduit. The methods also include actuating a shape charge device that is positioned within the tubing conduit. The actuating includes forming a plurality of openings within the production tubing with a plurality of projectiles of the shape charge device by accelerating the plurality of projectiles through the production tubing and into the annular space.

The actuating also includes severing the at least one control line at a plurality of locations with at least a subset of the plurality of projectiles.

The methods also include positioning a diversion structure within the uphole region of the tubing conduit. The diversion structure is configured to restrict fluid communication from the uphole region of the tubing conduit into the annular space via at least a subset of the plurality of openings that is uphole from a sealing material injection region of the tubing conduit.

The methods further include pumping a sealing material via the tubing conduit and into the annular space at the sealing material injection region. The methods also include curing the sealing material to form a fluid seal that extends both within the annular space and within the uphole region of the tubing conduit.

DETAILED DESCRIPTION AND BEST MODE OF THE DISCLOSURE

Figure 1:
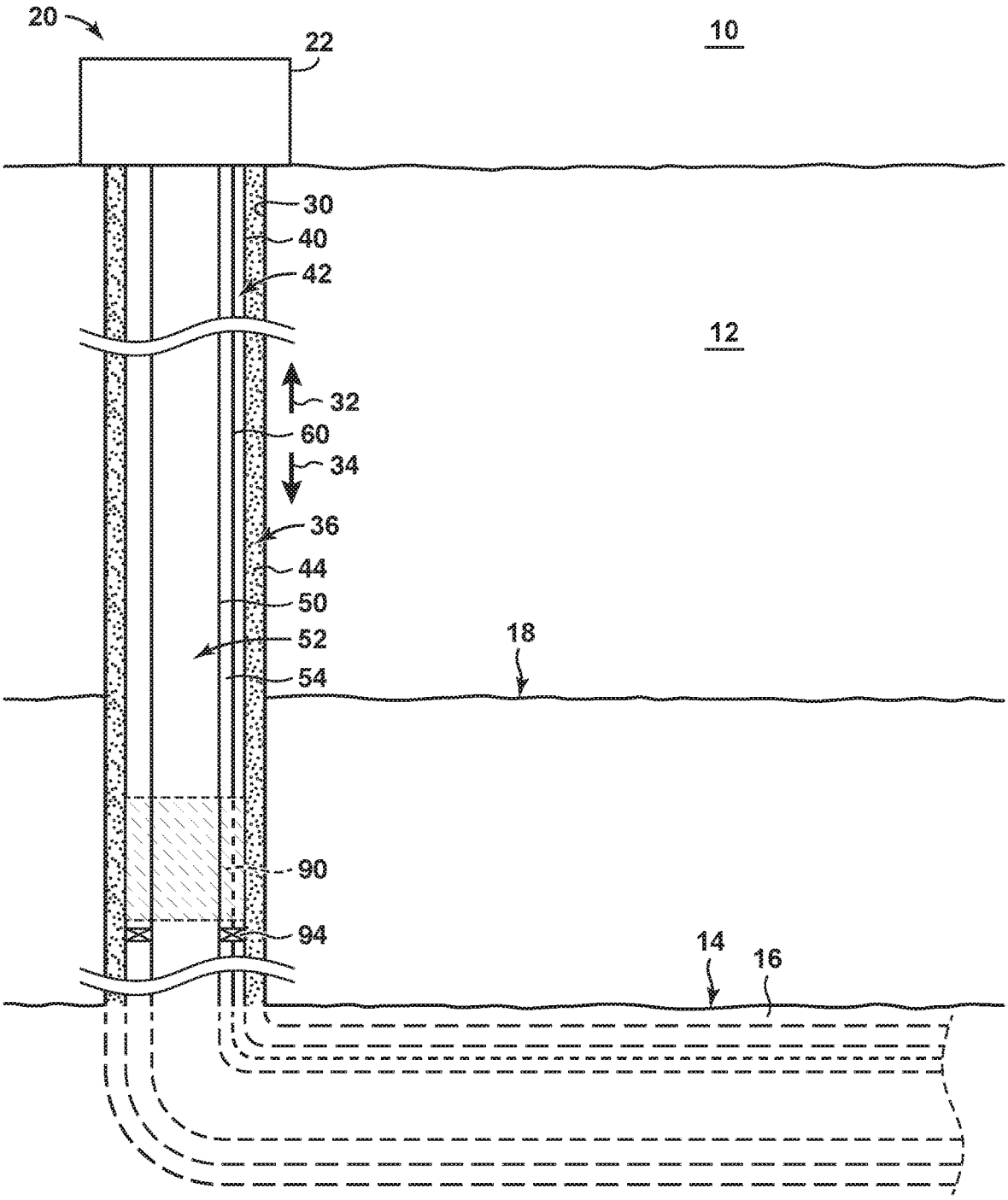
FIG. 1 is a schematic illustration of examples of a hydrocarbon well that may include and/or may be utilized with methods, according to the present disclosure.

FIGS. 1-22 provide examples of hydrocarbon wells 20 and/or of methods 200, according to the present disclosure. Elements that serve a similar, or at least substantially similar, purpose are labeled with like numbers in each of FIGS. 1-22, and these elements may not be discussed in detail herein with reference to each of FIGS. 1-22. Similarly, all elements may not be labeled in each of FIGS. 1-22, but reference numerals associated therewith may be utilized herein for consistency. Elements, components, and/or features that are discussed herein with reference to one or more of FIGS. 1-22 may be included in and/or utilized with any of FIGS. 1-22 without departing from the scope of the present disclosure. In general, elements that are likely to be included in a particular embodiment are illustrated in solid lines, while elements that are optional are illustrated in dashed lines. However, elements that are shown in solid lines may not be essential and, in some embodiments, may be omitted without departing from the scope of the present disclosure.

FIG. 1 is a schematic illustration of examples of a hydrocarbon well 20 that may include and/or may be utilized with methods, according to the present disclosure. Hydrocarbon well 20 includes a wellhead 22 and a wellbore 30. Wellbore 30 extends within a subterranean formation 14 and also may be referred to herein as extending within a subsurface region 12 and/or as extending between a surface region 10 and subterranean formation 14. Subterranean formation 14 includes hydrocarbons 16, and a cap rock 18 may separate the subterranean formation from the surface region. Wellbore 30 defines an uphole direction 32 and a downhole direction 34. Uphole direction 32 extends generally along the length of the wellbore and toward surface region 10, while downhole direction 34 extends generally along the length of the wellbore and away from the surface region.

Hydrocarbon well 20 includes a casing string 40, which extends within wellbore 30 and defines a casing conduit 42. A casing seal 44, such as cement, extends between wellbore 30 and casing string 40. Additionally or alternatively, the casing seal fluidly seals an annular space 36 that extends between the wellbore and the casing string.

The hydrocarbon well also includes production tubing 50, which extends within casing conduit 42 and defines a tubing conduit 52. Casing string 40 and production tubing 50 define an annular space 54 therebetween. One or more production packers, or packers, 94 may extend within annular space 54 and/or may restrict fluid communication between a region of the annular space that is downhole from the production packer and a region of the annular space that is uphole from the production packer.

At least one control line 60 extends within annular space 54. Control line 60 may include any suitable electrical, hydraulic, and/or pneumatic control line that may be adapted, configured, designed, and/or constructed to convey one or more power and/or control signals along the length of wellbore 30 and/or between surface region 10 and subsurface region 12. In practice, control line 60 may be anchored, tied, and/or otherwise affixed to an external surface of production tubing 50 and/or to an internal surface of casing string 40. In one embodiment, the control line is operatively attached to the production tubing at, or near, casing collars of the production tubing. However, these particular configurations are not required of all embodiments.

As discussed, it may be desirable to form a plug, or fluid seal, 90 within hydrocarbon well 20 and/or within wellbore 30 thereof, such as to permit and/or facilitate abandonment of the hydrocarbon well. As illustrated, fluid seal 90 may extend both within annular space 54 and within tubing conduit 52, thereby restricting fluid flow therepast within both the annular space and the tubing conduit.

As also discussed, control line 60 may represent a potential leak pathway through fluid seal 90. As an example, control line 60 may include an insulated wire, and degradation of the insulation and/or of the wire may cause a leak path through fluid seal 90. As another example, control line 60 may include a stranded wire than inherently may include the leak path. As yet another example, control line 60 may include a fluid conduit, such as a hydraulic and/or a pneumatic fluid conduit, that inherently may include the leak path.

With this in mind, methods 200, which are discussed in more detail herein with reference to FIGS. 2-22, may be configured to break, to shear, to disrupt, and/or to sever control line 60 at a plurality of locations along a length thereof. Severance of the control line is illustrated schematically in FIG. 1 by the dotted lines for the portion of the control line that extends through the fluid seal.

Methods 200, which are disclosed herein, form the fluid seal subsequent to severing the control line, thereby decreasing a potential for existence and/or formation of the leak path through the fluid seal due to the presence of the control line extending, or extending entirely, through the fluid seal. These methods also sever the control line and form the fluid seal without removing a remainder of the control line and/or the production tubing from the casing conduit, thereby providing significant decreases in required time, labor, and/or costs when compared to conventional processes for plugging and abandonment of hydrocarbon wells.

Figure 2:
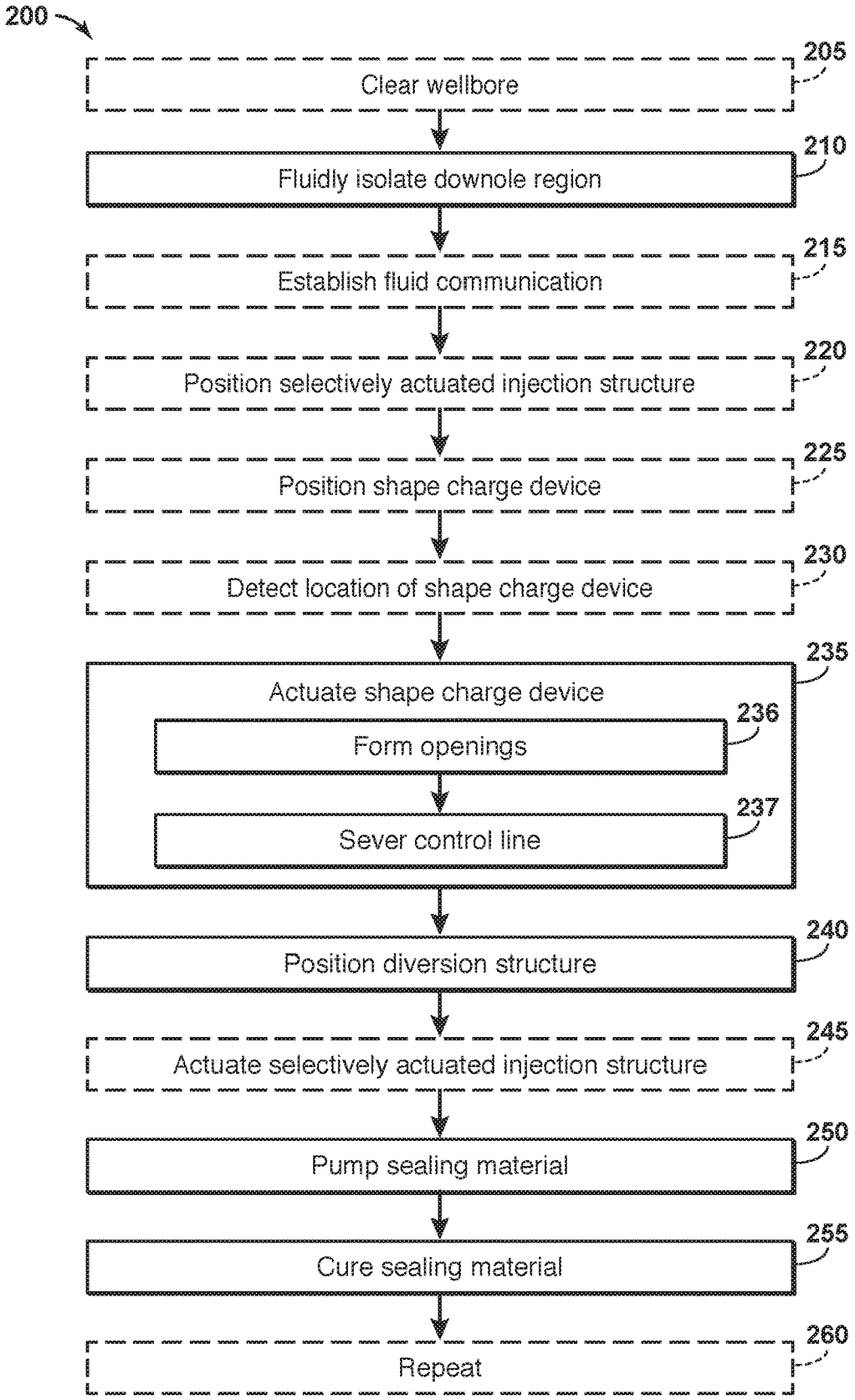
FIG. 2 is a flowchart depicting methods, according to the present disclosure, of sealing a hydrocarbon well.

FIG. 2 is a flowchart depicting methods 200, according to the present disclosure, of sealing a hydrocarbon well. FIGS. 3-22 are schematic cross-sectional views of a region of a hydrocarbon well illustrating various portions, or steps, of the methods of FIG. 2.

Methods 200 may include clearing a wellbore at 205 and include fluidly isolating a downhole region of the wellbore at 210. Methods 200 also may include establishing fluid communication at 215, positioning a selectively actuated injection structure at 220, positioning a shape charge device at 225, and/or detecting a location of the shape charge device at 230. Methods 200 include actuating the shape charge device at 235 and positioning a diversion structure at 240. Methods 200 further may include actuating the selectively actuated injection structure at 245, and methods 200 include pumping a sealing material at 250 and curing the sealing material at 255. Methods 200 also may include repeating at least a portion of the methods at 260.

Clearing the wellbore at 205, when performed, may include at least partially, or even completely, removing any suitable material and/or materials from the wellbore in any suitable manner. As an example, the clearing at 205 may include removing downhole equipment from the wellbore. As another example, the clearing at 205 may include cleaning the wellbore. The cleaning the wellbore may include cleaning with, via, and/or utilizing coiled tubing.

The clearing at 205, when performed, may be performed prior to the positioning at 220, prior to the positioning at 225, and/or prior to the fluidly isolating at 210. However, this is not required of all embodiments, and it is within the scope of the present disclosure that the clearing at 205 may be performed with any suitable sequence and/or timing within and/or during methods 200.

Figure 3:
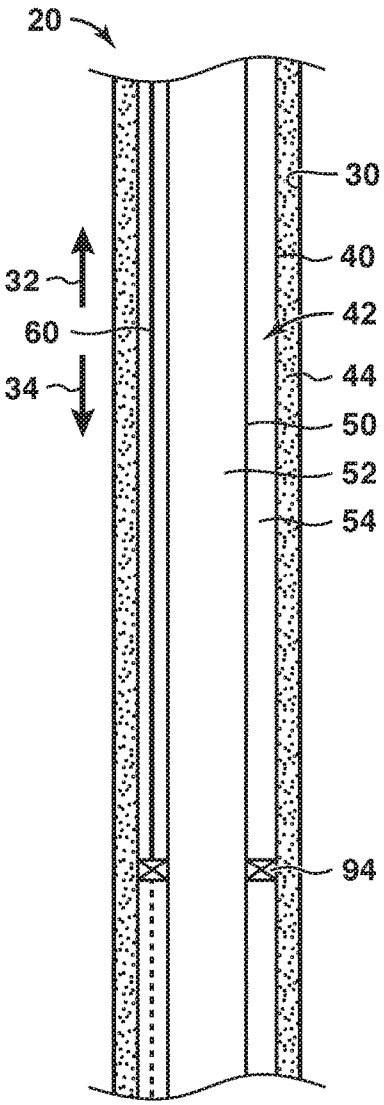
FIG. 3 is a schematic cross-sectional view of a region of a hydrocarbon well illustrating a portion of the methods of FIG. 2.

FIG. 3 schematically illustrates a hydrocarbon well 20 subsequent to the clearing at 205. As illustrated therein, tubing conduit 52 may be free, or at least substantially free, of debris and/or downhole equipment subsequent to performing the clearing at 205.

Fluidly isolating the downhole region at 210 may include fluidly isolating any suitable downhole region of a tubing conduit from an uphole region of the tubing conduit. As illustrated collectively by FIGS. 1 and 3-22 and discussed herein with reference to FIG. 1, hydrocarbon well 20 includes a wellbore 30 that extends within a subterranean formation 14. A casing string 40 extends within the wellbore and defines a casing conduit 42. Production tubing 50 extends within the casing conduit and defines a tubing conduit 52. In addition, at least one control line 60 extends within an annular space 54 that is defined between the casing string and the production tubing.

The fluidly isolating at 210 may include fluidly isolating such that the downhole region of the tubing conduit is at least partially downhole from the at least one control line and/or such that the downhole region is completely downhole from the at least one control line. However, this is not required of all embodiments, and it is within the scope of the present disclosure that the at least one control line may be coextensive with at least a fraction, a majority, or even all of the downhole region of the tubing conduit.

The fluidly isolating at 210 additionally or alternatively may include fluidly isolating such that the uphole region of the tubing conduit is at least partially, or even completely, coextensive, within the wellbore, with the at least one control line. Stated another way, the at least one control line may extend within a portion, or region, of the annular space that is defined by a portion, or region, of the production tubing that also defines the uphole region of the tubing conduit.

The fluidly isolating at 210 may include fluidly isolating in any suitable manner. As an example, the fluidly isolating at 210 may include fluidly isolating with, via, and/or utilizing an isolation device. Under these conditions, methods 200, or the fluidly isolating at 210 further may include flowing and/or otherwise conveying the isolation device past a target portion of the uphole region of the tubing conduit, which is discussed in more detail herein.

Figure 4:
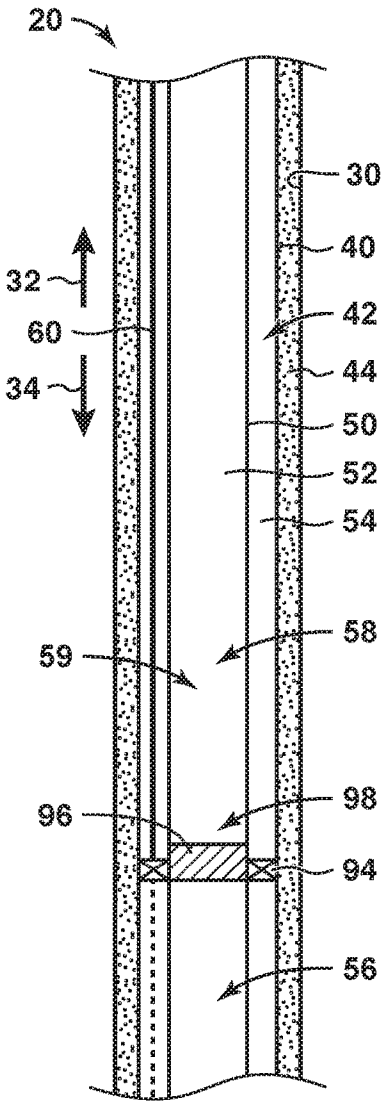
FIG. 4 is a schematic cross-sectional view of a region of a hydrocarbon well illustrating a portion of the methods of FIG. 2.

The fluidly isolating at 210 is schematically illustrated in FIG. 4. As illustrated therein, an isolation device 96 fluidly isolates a downhole region 56 of tubing conduit 52 from an uphole region 58 of the tubing conduit. As also illustrated, the isolation device is downhole from a target portion 59 of the uphole region of the tubing conduit. Examples of the isolation device include any suitable plug, packer, and/or other device configured to be positioned within the tubing conduit and to form an at least temporary fluid seal between the uphole region of the tubing conduit and the downhole region of the tubing conduit.

Establishing fluid communication at 215, when performed, may include establishing fluid communication between the tubing conduit and the annular space at a sealing material injection region of the tubing conduit. This may include establishing fluid communication in any suitable manner, such as by perforating and/or otherwise forming a hole within the tubing conduit at the sealing material injection region.

Figure 5:
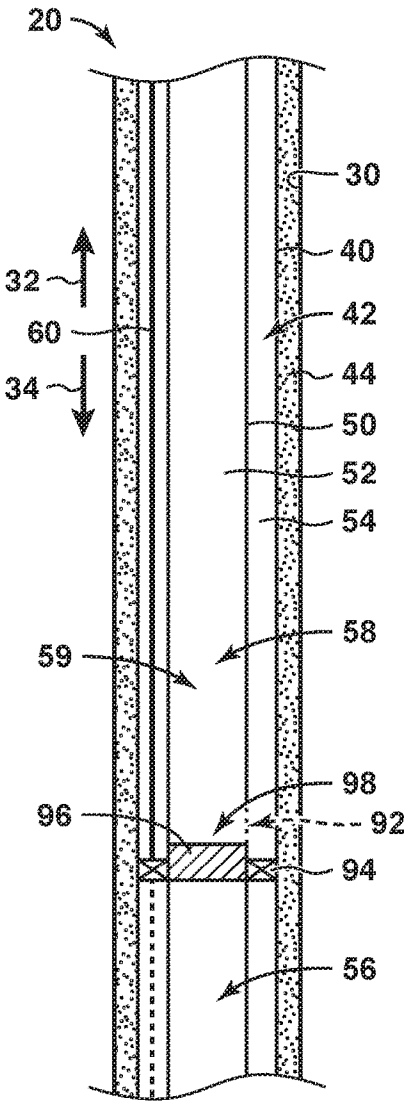
FIG. 5 is a schematic cross-sectional view of a region of a hydrocarbon well illustrating a portion of the methods of FIG. 2.

The establishing at 215 is schematically illustrated in FIG. 5. As illustrated therein, a perforation 92 may be formed within production tubing 50 at a sealing material injection region 98 of tubing conduit 52.

Positioning the selectively actuated injection structure at 220, when performed, may include positioning the selectively actuated injection structure at and/or within the sealing material injection region of the tubing conduit. It is within the scope of the present disclosure that the selectively actuated injection structure may be operatively attached to the isolation structure, form a portion of the isolation structure, and/or may be distinct from the isolation structure. When the selectively actuated injection structure is operatively attached to and/or forms a portion of the isolation structure, the positioning at 220 may be performed at least partially concurrently with, or as a result of, the fluidly isolating at 210. When the selectively actuated injection structure is distinct from the isolation structure, the positioning at 220 may be performed at least partially concurrently with and/or subsequent to the fluidly isolating at 210.

When methods 200 include the establishing at 215, the positioning at 220 may include positioning such that the selectively actuated injection structure restricts, or selectively restricts, fluid communication between the tubing conduit and the annular space at and/or within the sealing material injection region. Stated another way, the positioning at 220 may include selectively and/or temporarily blocking, occluding, and/or restricting the fluid communication between the tubing conduit and the annular space at and/or within the sealing material injection region. As such, and as discussed in more detail herein, the actuating at 245 may include actuating the selectively actuated injection structure to re-establish the fluid communication between the tubing conduit and the annular space at and/or within the sealing material injection region. Examples of such a selectively actuated injection structure include any suitable selectively actuated injection structure. Examples of the selectively actuated injection structure include a rupture disk, a burst disk, a check valve, a sliding sleeve, and/or a straddle sleeve.

Additionally or alternatively, the selectively actuated injection structure may include and/or be a shape charge injection structure. The shape charge injection structure may be configured to, responsive to the actuating at 245, perforate the production tubing at and/or within the sealing material injection region. An example of such a shape charge injection structure includes a perforate-and-squeeze cement retainer.

Figure 6:
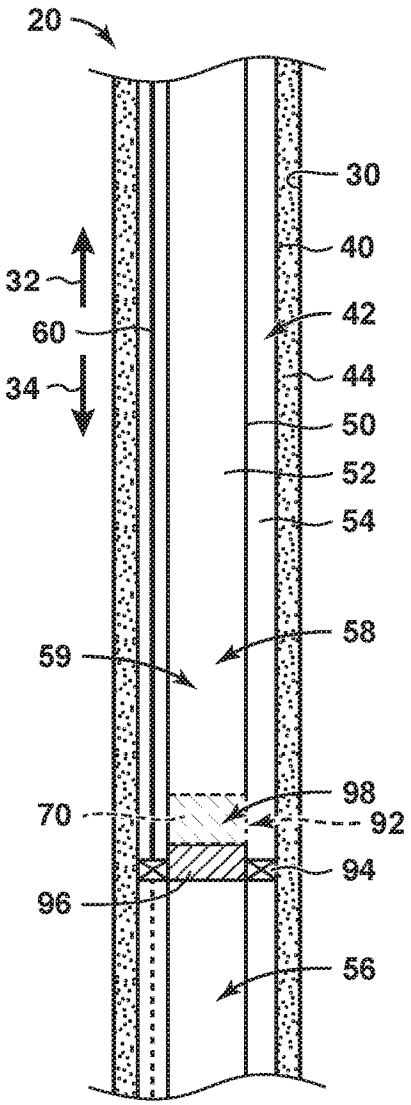
FIG. 6 is a schematic cross-sectional view of a region of a hydrocarbon well illustrating a portion of the methods of FIG. 2.

The positioning at 220 is schematically illustrated in FIG. 6. As illustrated therein, a selectively actuated injection structure 70 may be positioned at and/or within sealing material injection region 98 of tubing conduit 52. When production tubing 50 includes perforation 92, the selectively actuated injection structure may block, restrict, and/or occlude fluid flow and/or communication between tubing conduit 52 and annular space 54 via the perforation.

Positioning the shape charge device at 225, when performed, may include positioning any suitable shape charge device within the target portion of the uphole region of the tubing conduit. As used herein, the "target portion of the uphole region" includes a portion of the uphole region that will be perforated by the shape charge device during the actuating at 235, which is discussed in more detail herein.

The positioning at 225 may be accomplished in any suitable manner. As an example, the positioning at 225 may include running and/or flowing the shape charge device within the tubing conduit, such as with, via, utilizing, and/or on an electric line and/or wireline.

When the fluidly isolating at 210 includes fluidly isolating with the isolation device, the positioning at 225 may include positioning the shape charge device at least partially concurrently with the flowing the isolation device. As an example, the shape charge device may be operatively attached to and/or may form a portion of the isolation device. As another example, the shape charge device may be distinct from the isolation device but still may be positioned at least partially concurrently with the isolation device. However, this is not required of all embodiments, and it is within the scope of the present disclosure that the positioning at 225 may be performed subsequent to the fluidly isolating at 210 and/or subsequent to the flowing the isolation device.

Figure 7:
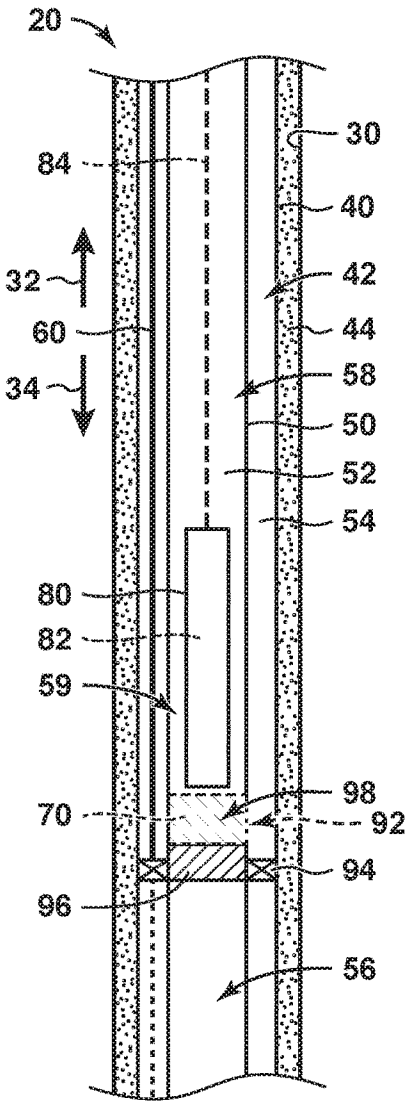
FIG. 7 is a schematic cross-sectional view of a region of a hydrocarbon well illustrating a portion of the methods of FIG. 2.

An example of the positioning at 225 is illustrated in FIG. 7. As illustrated therein, a shape charge device 80 is positioned within target portion 59 of uphole region 58 of tubing conduit 52. FIG. 7 illustrates that the shape charge device optionally may be positioned utilizing an electric line, or wireline, 84. However, this is not required of all embodiments, and it also is within the scope of the present disclosure that the shape charge device may be positioned utilizing a tractor and/or that the shape charge device may include and/or be an autonomous shape charge device that may not, necessarily, be attached to the electric line.

When methods 200 include the positioning at 225, methods 200 also may include the detecting the location of the shape charge device at 230. The detecting at 230 may include detecting the location of the shape charge isolation device and/or detecting when the shape charge device is within the target portion of the uphole region of the tubular conduit in any suitable manner. As an example, the detecting at 230 may include detecting with, via, and/or utilizing a casing collar locator that may be operatively attached to and/or may form a portion of the shape charge device. This is illustrated in FIG. 7, with shape charge device 80 optionally including a casing collar locator 82.

Actuating the shape charge device at 235 may include actuating when the shape charge device is within the target portion of the uphole region of the tubing conduit (e.g., when shape charge device 80 is within target portion 59 of uphole region 58, as illustrated in FIG. 7). When methods 200 include the detecting at 230, the actuating at 235 may be based upon and/or responsive to the detecting at 230.

The actuating at 235 includes forming, at 236, a plurality of openings within the production tubing. The plurality of openings may be formed with a plurality of projectiles of the shape charge device. Stated another way, the actuating at 235 may include accelerating the plurality of projectiles through the production tubing and into the annular space, such as to permit and/or facilitate the forming at 236. In addition, and when methods 200 include the positioning at 220, the positioning at 220 may include positioning the selectively actuated injection structure within a portion of the uphole region of the tubing conduit that is downhole from the plurality of openings formed during the forming at 236.

The forming at 236 may include forming any suitable openings within the production tubing. As examples, the forming at 236 may include forming a plurality of holes within the production tubing, forming a plurality of perforations within the production tubing, and/or forming a plurality of slits, or radial slits, within the production tubing. This may include forming the plurality of openings without severing the production tubing. Stated another way, the plurality of openings may provide a plurality of fluid communication pathways between the tubing conduit and the annular space; however, the production tubing may remain intact along a length thereof. By this it is meant that the production tubing is not completely severed into distinct uphole and downhole portions during the forming at 236. The forming at 236 additionally or alternatively may include forming the plurality of openings without forming a corresponding plurality of openings within the casing string. Stated another way, the shape charge device may be selectively adapted, configured, designed, and/or constructed such that the plurality of projectiles penetrates the production tubing but does not penetrate the casing string, does not fully penetrate the casing string, does not have enough energy to penetrate the casing string, and/or does not have enough energy to fully penetrate the casing string. However, this is not required of all embodiments, and it is within the scope of the present disclosure that one or more of the plurality of projectiles may penetrate both the production tubing and the casing string, may fully penetrate both the production tubing and the casing string, may have enough energy to penetrate both the production tubing and the casing string, and/or may have enough energy to fully penetrate both the production tubing and the casing string.

When the forming at 236 includes forming the plurality of radial slits, each of the plurality of radial slits may extend parallel, or at least substantially parallel, to a transverse cross-section of the production tubing. In addition, a rotation of the plurality of radial slits, within the transverse cross-section of the production tubing, may vary systematically along a length of the production tubing. Stated another way, the plurality of radial slits may be rotated relative to one another, along the length of the production tubing. As an example, each of the plurality of radial slits may be rotated, within the transverse cross-section of the production tubing, relative to an adjacent radial slit of the plurality of radial slits by a rotation angle. Examples of the rotation angle include rotation angles of at least 40 degrees, at least 50 degrees, at least 60 degrees, at least 70 degrees, at least 80 degrees, at least 90 degrees, at least 100 degrees, at least 110 degrees, at least 120 degrees, at most 280 degrees, at most 260 degrees, at most 240 degrees, at most 220 degrees, at most 200 degrees, at most 180 degrees, at most 160 degrees, at most 140 degrees, at most 120 degrees, and/or at most 100 degrees.

Each of the plurality of radial slits additionally or alternatively may have and/or define a radial extent within the transverse cross-section of the production tubing. Examples of the radial extent include radial extents of at least 40 degrees, at least 50 degrees, at least 60 degrees, at least 70 degrees, at least 80 degrees, at least 90 degrees, at least 100 degrees, at least 110 degrees, at least 120 degrees, at most 280 degrees, at most 260 degrees, at most 240 degrees, at most 220 degrees, at most 200 degrees, at most 180 degrees, at most 160 degrees, at most 140 degrees, at most 120 degrees, and/or at most 100 degrees.

Figure 11:
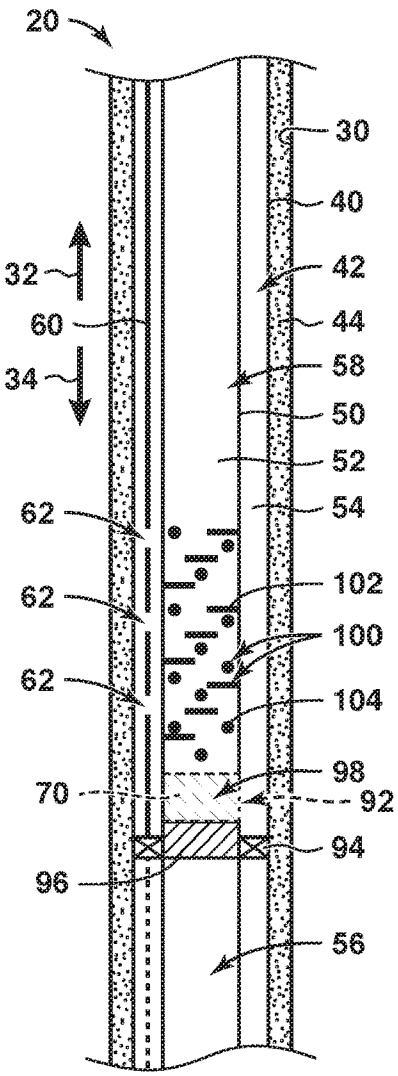
FIG. 11 is a schematic cross-sectional view of a region of a hydrocarbon well illustrating a portion of the methods of FIG. 2.
Figure 10:
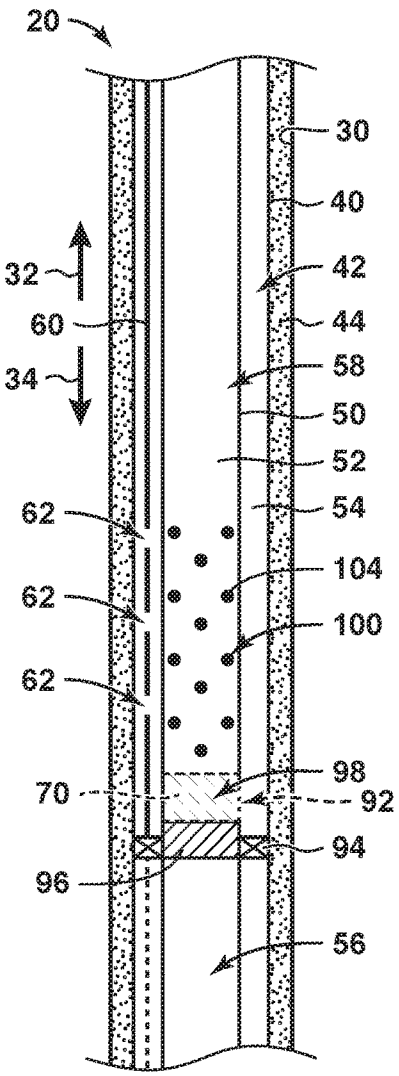
FIG. 10 is a schematic cross-sectional view of a region of a hydrocarbon well illustrating a portion of the methods of FIG. 2.
Figure 9:
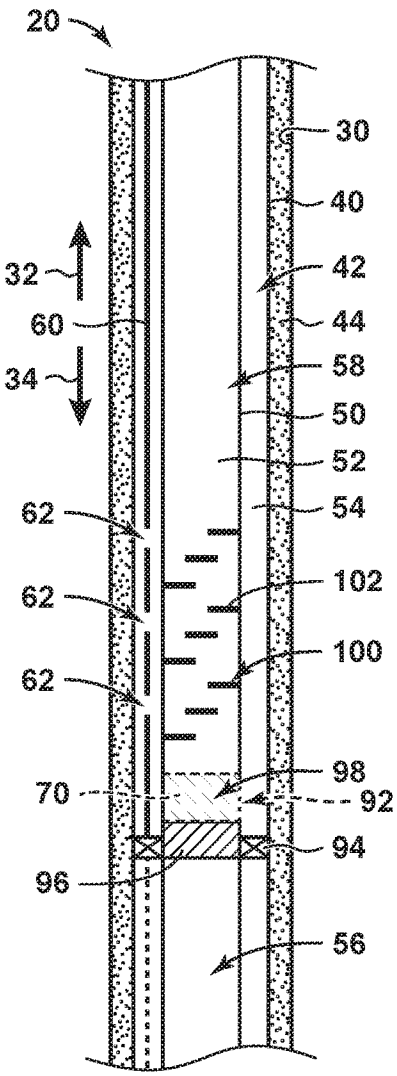
FIG. 9 is a schematic cross-sectional view of a region of a hydrocarbon well illustrating a portion of the methods of FIG. 2.
Figure 8:
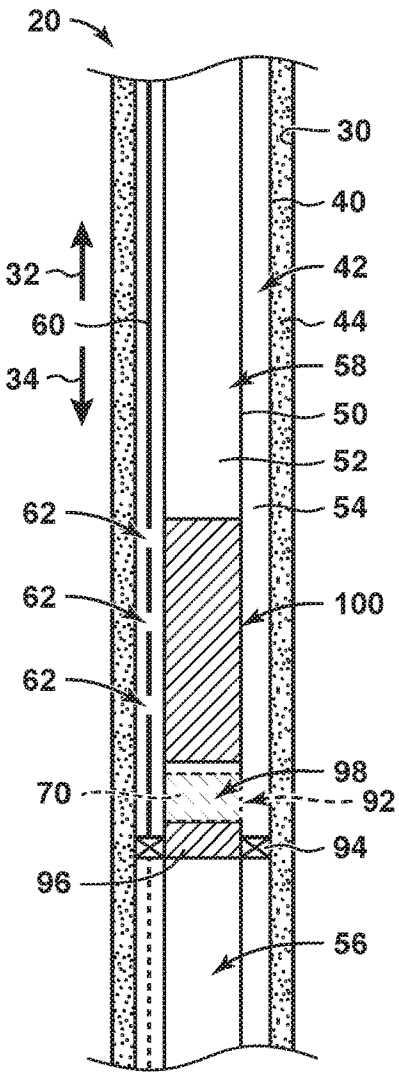
FIG. 8 is a schematic cross-sectional view of a region of a hydrocarbon well illustrating a portion of the methods of FIG. 2.

The forming at 236 is illustrated in FIGS. 8-11. FIG. 8 schematically illustrates production tubing 50 as including a plurality of openings 100. Openings 100 are more specifically illustrated as a plurality of slits, or radial slits, 102 in FIG. 9 and as a plurality of perforations 104 in FIG. 10. FIG. 11 illustrates that openings 100 within a given production tubing 50 may include both slits 102 and perforations 104. Such a configuration may provide increased and/or improved fluid communication between tubing conduit 52 and annular space 54.

The actuating at 235 also includes severing, at 237, the at least one control line at a plurality of locations. Stated another way, the severing at 237 may include cutting the at least one control line into a plurality of control line segments. This may include severing the at least one control line with, or via contact with, at least a subset of the plurality of projectiles. Stated another way, and subsequent to entering the annular space, the subset of the plurality of projectiles may contact and sever the at least one control line at the plurality of locations along a length of the at least one control line. When the forming at 236 includes forming the plurality of radial slits, the rotation of the plurality of radial slits within the transverse cross-section of the production tubing may permit and/or facilitate the severing at 237. By configuring the shape charge device such that the plurality of radial slits penetrates an entirety of a circumference of the production tubing, the actuating at 235 performs the severing at 237 without a need to know and/or quantify an exact position of the at least one control line within the annular space prior to the actuating at 235.

As discussed, the control line may be operatively attached to the production tubing at, or near, casing collars of the production tubing. Under these conditions, and when methods 200 include the detecting at 230, the severing at 237 may include severing the control line above, below, or both above and below an attachment point that operatively attaches the control line to the production tubing. Additionally or alternatively, the severing at 237 may include severing between adjacent attachment points and/or between adjacent casing collars.

The severing at 237 also is illustrated in FIGS. 8-11. As illustrated therein, the severing at 237 may produce and/or generate a plurality of severed locations 62 within control line 60.

It is within the scope of the present disclosure that methods 200 may be configured to perform the actuating at 235, including both the forming at 236 and the severing at 237, at a plurality of spaced-apart locations along the length of the production tubing. As examples, the shape charge device, or a single shape charge device, may be adapted, configured, designed, and/or constructed to perform the actuating at 235 at least 10, at least 25, at least 50, at least 75, at least 100, at least 150, or at least 200 times without being removed from the tubing conduit. Stated another way, the shape charge device may include and/or be a single, sequential-fire shape charge device that is configured to be actuated, or fired, at least 10, at least 25, at least 50, at least 75, at least 100, at least 150, or at least 200 times without being removed from the tubing conduit.

In addition, methods 200 may include repeating the actuating at 235 at least a threshold number of times at a threshold spacing to perform both the forming at 236 and the severing at 237 along at least a threshold length of the production tubing. Examples of the threshold number of times include at least 10, at least 25, at least 50, at least 75, at least 100, at least 150, or at least 200 times. Examples of the threshold spacing include threshold spacings of at least 1 meter (m), at least 2 m, at least 3 m, at least 4 m, at least 5 m, at least 7.5 m, at least 10 m, at most 20 m, at most 15 m, at most 10 m, at most 8 m, at most 6 m, and/or at most 4 m. Examples of the threshold length of the production tubing include threshold lengths of at least 20 m, at least 40 m, at least 60 m, at least 80 m, at least 100 m, at least 120 m, at least 140 m, at least 160 m, at most 250 m, at most 200 m, at most 175 m, at most 150 m, at most 140 m, and/or at most 130 m.

Positioning the diversion structure at 240 may include positioning the diversion structure within the uphole region of the tubing conduit. The diversion structure may be configured to resist, to restrict, to block, and/or to occlude fluid communication from the uphole region of the tubing conduit to the annular space via at least a subset, or even all, of the plurality of openings. This may include the subset, or all, of the plurality of openings that is uphole from the sealing material injection region of the tubing conduit.

The positioning at 240 may be accomplished in any suitable manner. As examples, the positioning at 240 may include flowing the diversion structure into contact with the subset of the plurality of openings, flowing the diversion structure into contact with each of the plurality of openings, and/or restricting fluid flow, from the uphole region of the tubing conduit and into the annular space, with the diversion structure.

The positioning at 240 additionally or alternatively may include positioning a corresponding diversion structure in contact with the subset of the plurality of openings, positioning a corresponding diversion structure in contact with each of the plurality of openings, embedding the corresponding diversion structure within each of the plurality of openings, and/or occluding fluid flow within each of the plurality of openings with the corresponding diversion structure.

Figure 15:
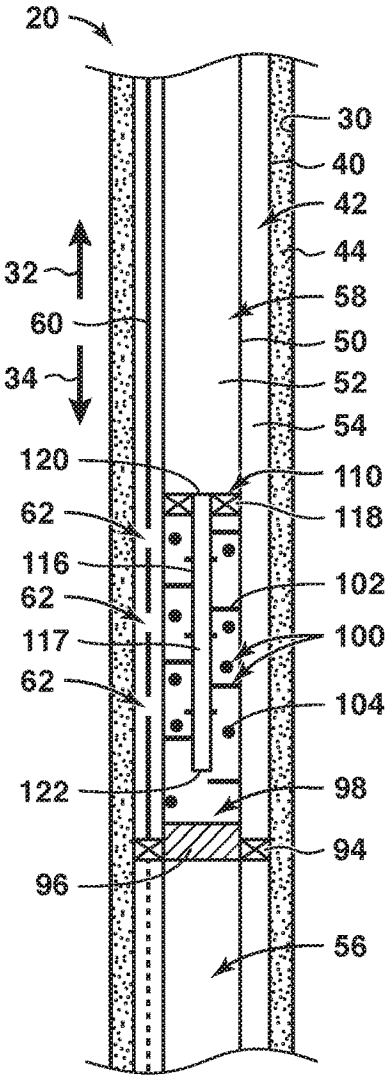
FIG. 15 is a schematic cross-sectional view of a region of a hydrocarbon well illustrating a portion of the methods of FIG. 2.
Figure 14:
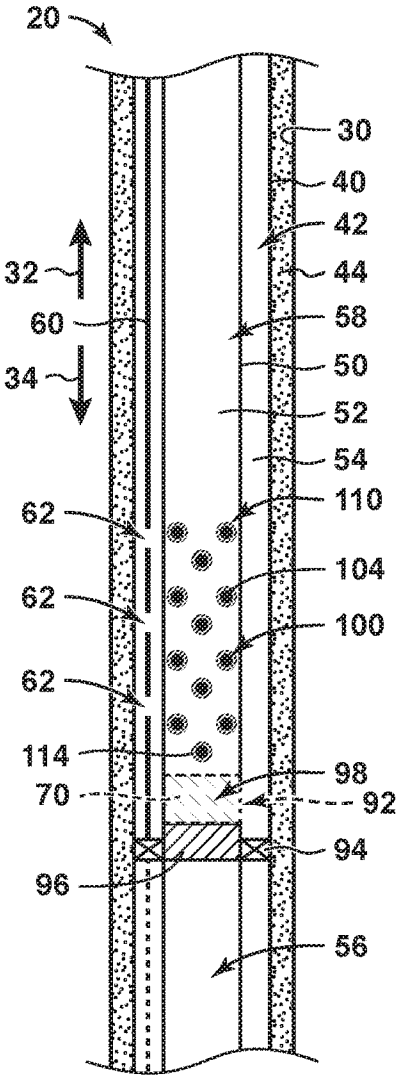
FIG. 14 is a schematic cross-sectional view of a region of a hydrocarbon well illustrating a portion of the methods of FIG. 2.
Figure 13:
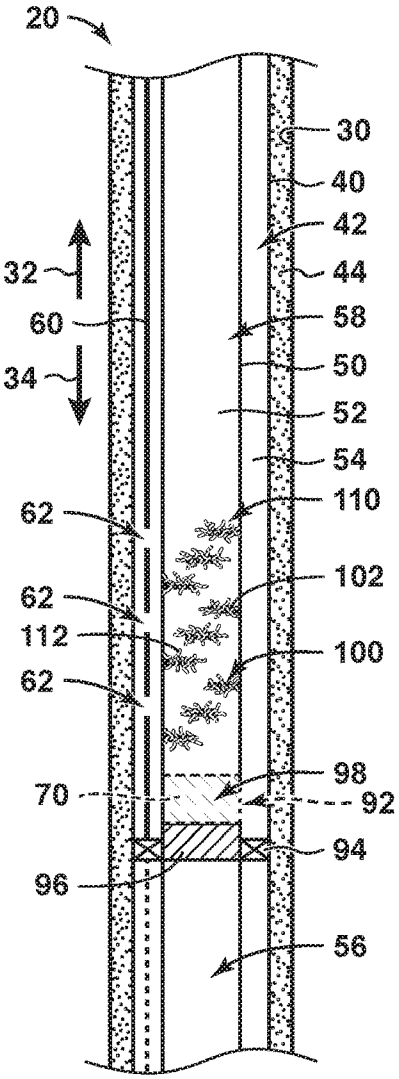
FIG. 13 is a schematic cross-sectional view of a region of a hydrocarbon well illustrating a portion of the methods of FIG. 2.
Figure 12:
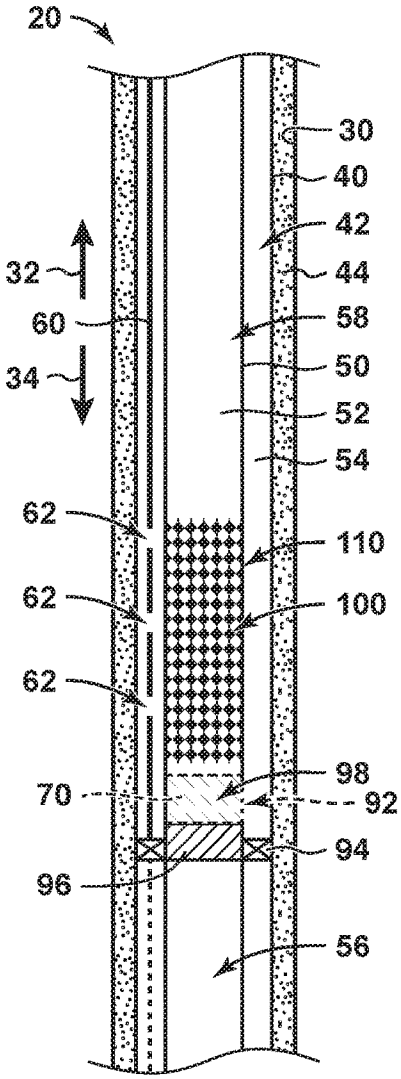
FIG. 12 is a schematic cross-sectional view of a region of a hydrocarbon well illustrating a portion of the methods of FIG. 2.

The diversion structure may include and/or be any suitable diversion structure, and examples of the diversion structure are illustrated in FIGS. 12-15. FIG. 12 schematically and generally illustrates that diversion structures 110 may cover openings 100, thereby restricting fluid flow therethrough. As illustrated in FIGS. 13-15, diversion structure 110 may include a plurality of discrete bodies, with at least one of these discrete bodies contacting and/or sealing a corresponding opening 100.

As an example, and as illustrated in FIG. 13, diversion structure 110 may include a plurality of filaments, or fibers, 112. Such a diversion structure may be particularly effective when openings 100 include slits 102; however, filaments and/or fibers also may be utilized with openings 100 in the form of perforations without departing from the scope of the present disclosure. As another example, and as illustrated in FIG. 14, diversion structure 110 may include a plurality of balls, or ball sealers, 114. Such a diversion structure may be particularly effective when openings 100 include perforations 104; however, balls and/or ball sealers also may be utilized with openings 100 in the form of slits without departing from the scope of the present disclosure.

As yet another example, and as illustrated in FIG. 15, the diversion structure may include a length of diversion tubing 116 that is operatively attached to a diversion packer 118. Under these conditions, the positioning at 240 may include retaining the length of diversion tubing within the tubing conduit with, via, and/or utilizing the diversion packer, such as by setting the diversion packer. The length of diversion tubing may have and/or define an uphole end 120, a downhole end 122, and a diversion tubing conduit 117 that extends between the uphole end and the downhole end. The diversion packer may be operatively attached to, or near, the uphole end of the length of diversion tubing, and the diversion packer may be positioned, within tubing conduit 52, uphole from the plurality of openings 100. In addition, the diversion packer may resist fluid flow, which is external to the diversion tubing conduit, therepast but may permit fluid flow within the diversion tubing conduit. Stated another way, the combination of length of diversion tubing 116 and diversion packer 118 may direct fluid flow, within tubing conduit 52, toward and/or into diversion tubing conduit 117. Furthermore, downhole end 122 of length of diversion tubing 116 may be downhole from the subset of the plurality of openings 100 that is uphole from sealing material injection region 98. As such, the pumping at 250, which is discussed in more detail herein, may include flowing the sealing material past the diversion packer, via the diversion tubing conduit, to the sealing material injection region. Stated another way, the combination of length of diversion tubing 116 and diversion packer 118 preferentially may direct the sealing material to and/or toward sealing material injection region 98.

Diversion structure 110 may be formed from any suitable material and/or materials. As examples, diversion structure 110 may be formed from and/or may include a polymer, rubber, nylon, and/or polylactic acid. As such, and when the diversion structure includes the plurality of discrete bodies, the plurality of discrete bodies also may be referred to herein as a plurality of polymer bodies, a plurality of rubber bodies, a plurality of nylon bodies, and/or a plurality of polylactic acid bodies.

Actuating the selectively actuated injection structure at 245, when performed, may include actuating to permit, facilitate, establish, or selectively establish fluid communication between the tubing conduit and the annular space. As an example, and as discussed, the positioning at 220 may include restricting fluid communication between the uphole region of the tubing conduit and the annular space via each, or all, of the plurality of openings. Under these conditions, and prior to the pumping at 250, the actuating at 245 may include actuating to establish fluid communication between the tubing conduit and the annular space at, or within, the sealing material injection region. This may include opening the selectively actuated injection structure to permit and/or facilitate fluid flow through a perforation that was formed during the establishing at 215. Additionally or alternatively, this also may include forming a perforation within the production tubing with the selectively actuated injection structure.

It is within the scope of the present disclosure that the actuating at 245 may include actuating the selectively actuated injection structure in any suitable manner. As an example, the selectively actuated injection structure may include and/or be a pressure-actuated selectively actuated injection structure. The pressure-actuated selectively actuated injection structure may be configured to establish the fluid communication responsive to a pressure, within the uphole region of the tubing conduit, exceeding a threshold actuation pressure. Under these conditions, the actuating at 245 may include pressurizing the uphole region of the tubing conduit to greater than the threshold actuation pressure.

As another example, the selectively actuated injection structure may include and/or be a wirelessly actuated selectively actuated injection structure. The wirelessly actuated selectively actuated injection structure may be configured to establish the fluid communication responsive to receipt of a wireless signal. Under these conditions, the actuating at 245 may include providing the wireless signal to the selectively actuated injection structure.

Figure 18:
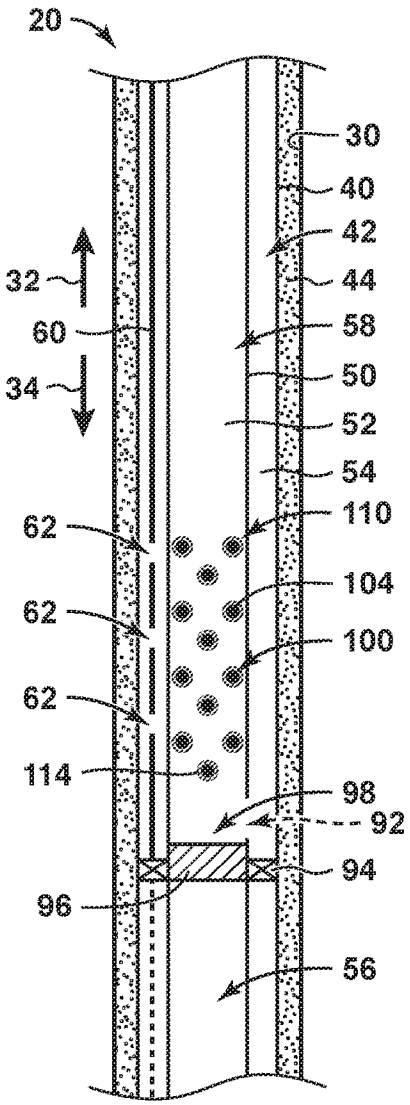
FIG. 18 is a schematic cross-sectional view of a region of a hydrocarbon well illustrating a portion of the methods of FIG. 2.
Figure 17:
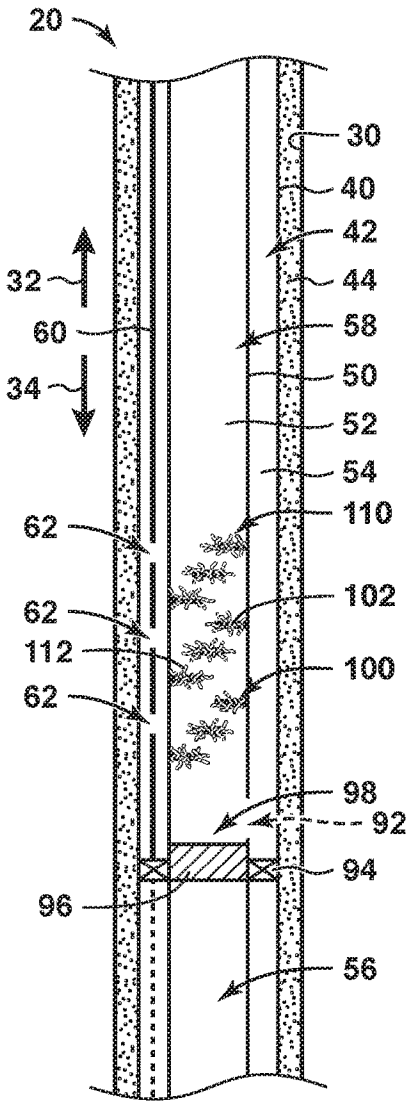
FIG. 17 is a schematic cross-sectional view of a region of a hydrocarbon well illustrating a portion of the methods of FIG. 2.
Figure 16:
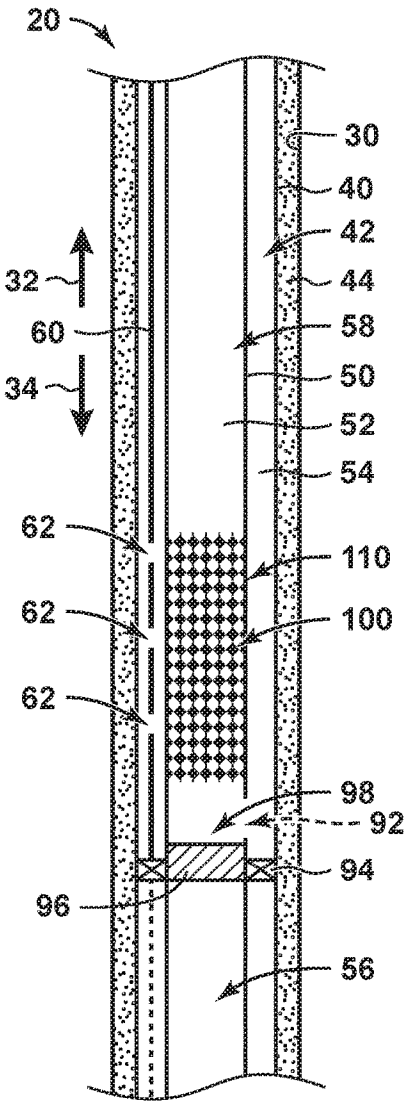
FIG. 16 is a schematic cross-sectional view of a region of a hydrocarbon well illustrating a portion of the methods of FIG. 2.

The actuating at 245 is illustrated in FIGS. 16-18. As illustrated therein, and subsequent to the actuating at 245, a perforation 92 provides fluid communication between tubing conduit 52 and annular space 54 at sealing material injection region 98. As discussed, perforation 92 may be pre-formed, such as during the establishing at 215. Under these conditions, the selectively actuated injection structure may include and/or be the rupture disk, the burst disk, the check valve, the sliding sleeve, and/or the straddle sleeve. Additionally or alternatively, the perforation may be formed by the selectively actuated injection structure during the actuating at 245. Under these conditions, the selectively actuated injection structure may include and/or be the shape charge injection structure. As illustrated in FIGS. 16-18, methods 200 include maintaining diversion structure 110 in contact with and/or sealing openings 100 during the actuating at 245.

Pumping the sealing material at 250 may include pumping the sealing material, via the tubing conduit, into the annular space at the sealing material injection region. The pumping at 250 may include pumping the sealing material past the diversion structure and into the annular space. Additionally or alternatively, the pumping at 250 may include pumping without utilizing coiled tubing, pumping utilizing the tubing conduit, and/or physically contacting the sealing material with the production tubing within a region of the tubing conduit that is uphole from the plurality of openings. Stated another way, the tubing conduit, or an entirety of a transverse cross-sectional area of the tubing conduit, may be utilized to provide the sealing material to the sealing material injection region.

Figure 22:
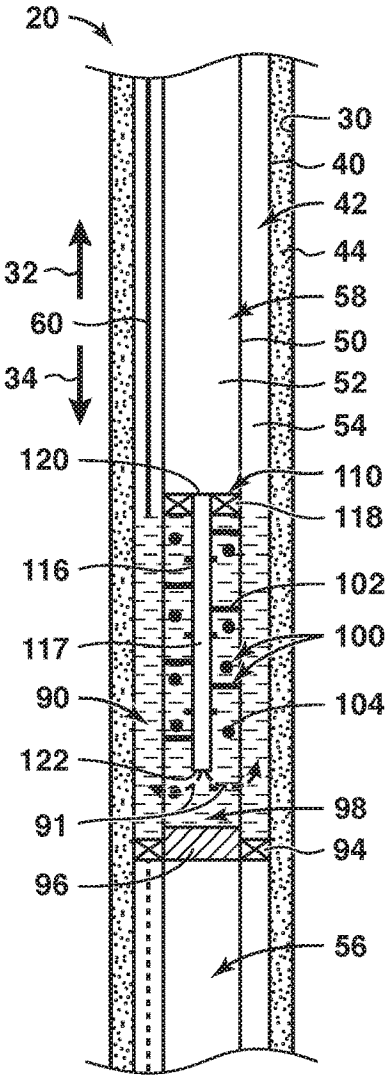
FIG. 22 is a schematic cross-sectional view of a region of a hydrocarbon well illustrating a portion of the methods of FIG. 2.
Figure 21:
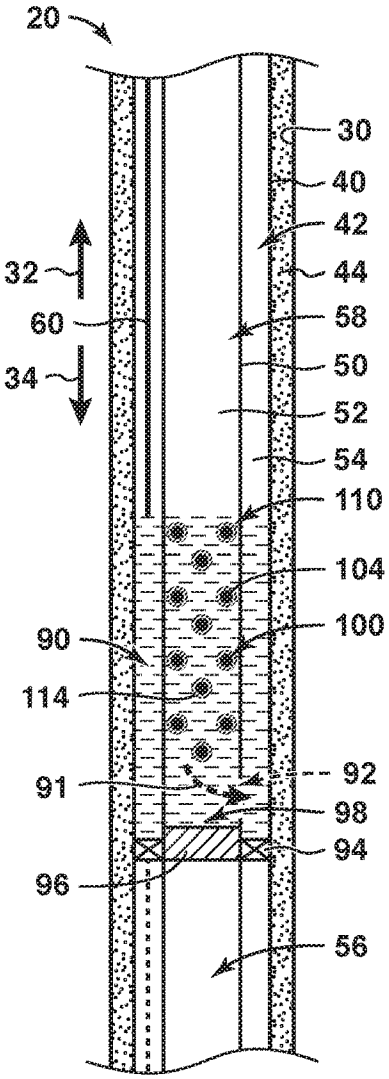
FIG. 21 is a schematic cross-sectional view of a region of a hydrocarbon well illustrating a portion of the methods of FIG. 2.
Figure 20:
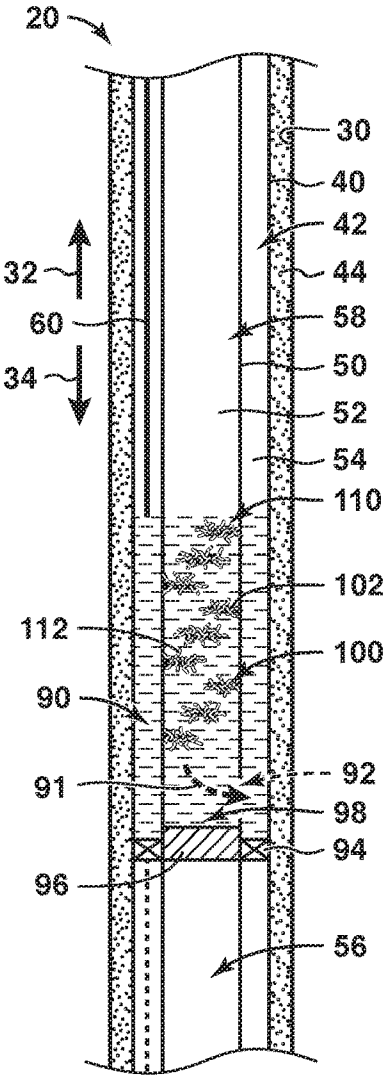
FIG. 20 is a schematic cross-sectional view of a region of a hydrocarbon well illustrating a portion of the methods of FIG. 2.
Figure 19:
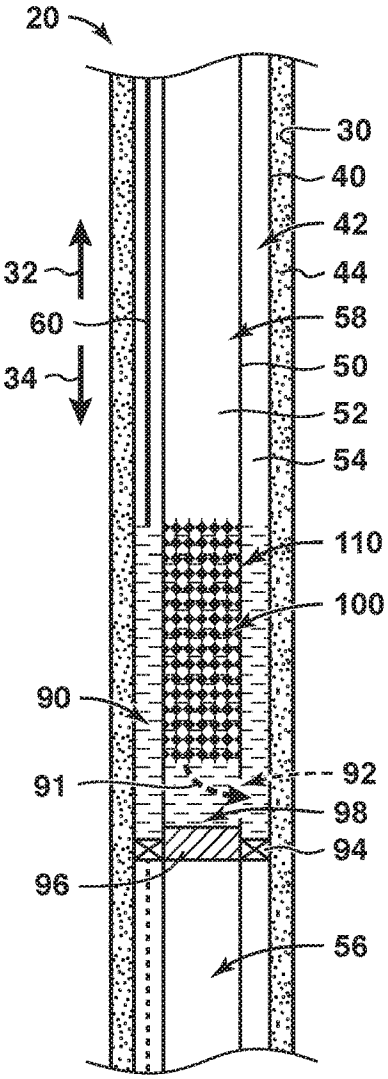
FIG. 19 is a schematic cross-sectional view of a region of a hydrocarbon well illustrating a portion of the methods of FIG. 2.

The pumping at 250 may include pumping to fill and/or to encapsulate an entirety of a region of the production tubing that includes the openings. Stated another way, the pumping at 250 may include encapsulating each of the plurality of openings with the sealing material. This may be accomplished in any suitable manner. As an example, and as illustrated in FIGS. 19-21, the pumping at 250 may include flowing a sealing material 91 through perforation 92 that was opened during the actuating at 245. As another example, and as illustrated in FIG. 22, the pumping at 250 may include flowing the sealing material through openings 100 that are proximal downhole end 122 of length of diversion tubing 116. Regardless of the exact configuration, the pumping at 250 generally is configured to encapsulate openings 100 in a bottom-up fashion (e.g., to encapsulate a given opening 100 prior to encapsulating openings that are uphole therefrom). Such a configuration may improve an integrity of the fluid seal that is formed during the curing at 255.

The sealing material may include and/or be any suitable sealing material. As an example, the sealing material may include cement, and the pumping at 250 may include pumping the cement.

Curing the sealing material at 255 may include curing the sealing material to form, it) establish, and/or define a fluid seal that extends both within the annular space and within the uphole region of the tubing conduit. The curing at 255 may be accomplished in any suitable manner. As examples, the curing at 255 may include waiting a cure time and/or contacting the sealing material with a curing agent.

The configuration of the hydrocarbon well subsequent to the pumping at 250 and the curing at 255 is illustrated in FIGS. 19-22. FIG. 19 schematically and generally illustrates that the sealing material may form a fluid seal 90 that encapsulates openings 100, while FIGS. 20-22 illustrate more specific configurations for openings 100 and/or for diversion structures 110 that may be utilized with openings 100. Regardless of the exact configuration, and as illustrated, fluid seal 90 fills a region of both annular space 54 and tubing conduit 52 that includes openings 100. As also illustrated, control line 60 does not extend through, or at least does not extend through an entirety of, fluid seal 90. As such, control line 60 does not represent a leak path for fluid seal 90, as may be the case for more conventional plugging and abandonment techniques, as discussed herein.

Repeating at least a portion of the methods at 260, when performed, may include repeating any suitable portion of methods 200 in any suitable manner. As an example, the fluid seal may be a first, or an initial, fluid seal, and the repeating at 260 may include repeating to form, define, and/or establish a second, or subsequent, fluid seal, which generally will be uphole from the first fluid seal. This may include repeating at least the actuating at 235, the forming at 236, the severing at 237, the positioning at 240, the pumping at 250, and the curing at 255 to form the second fluid seal within the annular space and within the uphole region of the tubing conduit.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

INDUSTRIAL APPLICABILITY

The methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A method of sealing a hydrocarbon well, the method comprising:

positioning an isolation device within a tubing conduit to fluidly isolate a downhole region of a tubing conduit from an uphole region of the tubing conduit, wherein the hydrocarbon well includes a wellbore extending within a subterranean formation, a casing string extending within the wellbore and defining a casing conduit, production tubing extending within the casing conduit and defining the tubing conduit, and at least one control line extending within an annular space defined between the casing string and the production tubing;

actuating a shape charge device positioned within a target portion of the uphole region of the tubing conduit, wherein the actuating the shape charge device includes:

(i) forming a plurality of openings within the target portion with a plurality of projectiles of the shape charge device by accelerating the plurality of projectiles through the production tubing and into the annular space; and (ii) severing the at least one control line at a plurality of locations with at least a subset of the plurality of accelerated projectiles;

creating an aperture in a sealing material injection region of the uphole region of the tubing conduit, the sealing material injection region located between the isolation device and at least a portion of the formed plurality of openings;

positioning a diversion structure within the uphole region of the tubing conduit, wherein the diversion structure is configured to restrict fluid communication from the uphole region of the tubing conduit to the annular space via at least a subset of the formed plurality of openings that is uphole from the aperture in the sealing material injection region of the tubing conduit;

pumping a sealing material via the tubing conduit from the uphole region of the tubing conduit into the annular space at the sealing material injection region wherein the diversion structure directs the sealing material in the production tubing to flow past the subset of the plurality of the openings having restricted fluid communication, to the aperture in the sealing material injection region, and into the annular space adjacent the formed plurality of openings, while leaving a portion of the pumped sealing material within the production tubing; and curing the sealing material to form a fluid seal that extends both within the annular space and within the uphole region of the tubing conduit, including sealing across the subset of formed plurality of openings and the diversion structure.

2. The method of claim 1, wherein the method further includes positioning a selectively actuated injection structure at the sealing material injection region;

wherein the positioning the diversion structure includes restricting fluid communication between the uphole region of the tubing conduit and the annular space via each of the plurality of openings; and further wherein, prior to the pumping, the method includes actuating the selectively actuated injection structure to establish fluid communication between the uphole region of the tubing conduit and the annular space at the sealing material injection region.

3. The method of claim 2, wherein the positioning the selectively actuated injection structure includes positioning the selectively actuated injection structure within a portion of the uphole region of the tubing conduit that is downhole from the plurality of openings formed during the forming the plurality of openings.

4. The method of claim 2, wherein the selectively actuated injection structure includes at least one of:

(i) a rupture disk;

(ii) a burst disk;

(iii) a check valve;

(iv) a sliding sleeve; and (v) a straddle sleeve.

5. The method of claim 4, wherein, prior to the positioning the selectively actuated injection structure, the method includes establishing fluid communication between the tubing conduit and the annular space at the sealing material injection region, and further wherein the positioning the selectively actuated injection structure includes restricting the fluid communication between the tubing conduit and the annular space at the sealing material injection region.

6. The method of claim 2, wherein the selectively actuated injection structure includes a shape charge injection structure configured to, upon actuation, perforate the production tubing at the sealing material injection region.

7. The method of claim 2, wherein the selectively actuated injection structure is a pressure-actuated selectively actuated injection structure configured to selectively establish fluid communication between the uphole region of the tubing conduit and the annular space at the sealing material injection region responsive to a pressure, within the uphole region of the tubing conduit, exceeding a threshold actuation pressure, and further wherein the actuating the selectively actuated injection structure includes pressurizing the uphole region of the tubing conduit to greater than the threshold actuation pressure.

8. The method of claim 2, wherein the selectively actuated injection structure is a wirelessly actuated selectively actuated injection structure configured to selectively establish fluid communication between the uphole region of the tubing conduit and the annular space at the sealing material injection region responsive to receipt of a wireless signal, and further wherein the actuating the selectively actuated injection structure includes providing the wireless signal to the selectively actuated injection structure.

9. The method of claim 1, wherein the positioning the diversion structure includes positioning at least one of:

(i) a plurality of balls;

(ii) a plurality of ball sealers;

(iii) a plurality of filaments;

(iv) a plurality of rubber bodies;

(v) a plurality of nylon bodies; and (vi) a plurality of polylactic acid bodies.

10. The method of claim 1, wherein the positioning the diversion structure includes retaining a length of diversion tubing within the tubing conduit with a diversion packer, wherein the length of diversion tubing defines an uphole end, a downhole end, and a diversion tubing conduit that extends between the uphole end of the length of diversion tubing and the downhole end of the length of diversion tubing.

11. The method of claim 10, wherein:

(i) the diversion packer is operatively attached to the uphole end of the length of diversion tubing;

(ii) the diversion packer is positioned uphole from the plurality of openings;

(iii) the diversion packer resists fluid flow, which is external to the diversion tubing conduit, therepast;

(iv) the diversion packer permits fluid flow, which is within the diversion tubing conduit, therepast; and (v) the downhole end of the length of diversion tubing is downhole from the subset of the plurality of openings that is uphole from the sealing material injection region.

12. The method of claim 10, wherein the pumping the sealing material includes flowing the sealing material past the diversion packer, via the diversion tubing conduit, to the sealing material injection region.

13. The method of claim 1, wherein the forming the plurality of openings includes forming the plurality of openings without severing the production tubing.

14. The method of claim 1, wherein the forming the plurality of openings includes forming the plurality of openings without forming a corresponding plurality of openings within the casing string.

15. The method of claim 1, wherein the forming the plurality of openings includes forming a plurality of radial slits.

16. The method of claim 15, wherein each of the plurality of radial slits extends at least substantially parallel to a transverse cross-section of the production tubing, and further wherein a rotation of the plurality of radial slits, within the transverse cross-section of the production tubing, varies intermittently along a length of the production tubing.

17. The method of claim 1, wherein the severing the at least one control line includes cutting the at least one control line into a plurality of control line segments.

18. The method of claim 1, wherein the pumping the sealing material includes physically contacting the sealing material with the production tubing within a region of the tubular conduit that is uphole from the plurality of openings.

19. The method of claim 1, wherein the pumping the sealing material includes encapsulating each of the plurality of openings within the sealing material.

20. The method of claim 1, wherein the fluid seal is a first fluid seal, and further wherein the method includes repeating at least the actuating the shape charge device, the forming the plurality of openings, the severing the at least one control line, the positioning the diversion structure, the pumping the sealing material, and the curing the sealing material to form a second fluid seal that extends both within the annular space and within the uphole region of the tubing conduit and is uphole from the first fluid seal.

* * * * *